US006760645B2

(12) United States Patent
Kaplan et al.

(10) Patent No.: US 6,760,645 B2
(45) Date of Patent: Jul. 6, 2004

(54) TRAINING OF AUTONOMOUS ROBOTS

(75) Inventors: Frédéric Kaplan, Paris (FR); Pierre-Yves Oudeyer, Paris (FR)

(73) Assignee: Sony France S.A., Chichy la Garenne (FR)

( * ) Notice: Subject to any disclaimer, the term of this patent is extended or adjusted under 35 U.S.C. 154(b) by 0 days.

(21) Appl. No.: 10/134,909

(22) Filed: Apr. 29, 2002

(65) Prior Publication Data

US 2002/0183895 A1 Dec. 5, 2002

(30) Foreign Application Priority Data

Apr. 30, 2001 (EP) ..... 01401127

(51) Int. Cl.[7] ..... G05B 19/00

(52) U.S. Cl. ..... 700/245; 700/31; 700/248; 700/258; 700/259; 318/568.1; 318/568.11; 318/568.12; 318/568.2; 318/569; 901/1; 901/15; 901/47; 704/207; 704/209; 704/270

(58) Field of Search ..... 700/245, 31, 259, 700/248, 258; 318/568.1, 568.11, 568.12, 568.2, 569, 16, 565; 901/1, 15, 47; 704/207, 209, 270; 348/121

(56) References Cited

U.S. PATENT DOCUMENTS 4,657,104 A * 4/1987 Holland ..... 180/211
5,963,712 A * 10/1999 Fujita et al. ..... 318/568.12
6,038,493 A * 3/2000 Tow ..... 700/259
6,058,385 A * 5/2000 Koza et al. ..... 706/13
6,275,773 B1 * 8/2001 Lemelson et al. ..... 340/436
6,321,140 B1 * 11/2001 Fujita et al. ..... 250/253

OTHER PUBLICATIONS

Hara, Systems and Software: Sony readies entertainment robot for June debut, 1999, EETimes/Internet, pp. 1–3.*
Pfeifer, Emotion in robot design, 1993, IEEE, pp. 408–413.*
Kaplan et al., Robotic clicker training (draft), 2002, Internet, pp. 1–15.*
Breazeal et al., Infant–like social interactions between a robot and a human caregiver, 1998, Internet, p. 1–p. 44.*
Hara et al., Real–time facial interaction between human and 3D face robot, 1996, IEEE, pp. 401–409.*
Snibbe et al., A layered architecture for lifelike robotic motion, 1999, Internet, pp. 1–8.*
Fong et al., Collaboration, Dialogue, and Human–Robot Interaction, 2001, Internet, pp. 1–10.*
"Development of an autonomous quadruped robot for robot entertainment", M. Fujita and H. Kitano, in Autonomous Robots, 5, 1998.
"Robots for kids: Exploring new technologies for learning", A Druin and J. Hendler, Morgan Kaufman Publishers, 2000.

(List continued on next page.)

*Primary Examiner*—William A. Cuchlinski, Jr.
*Assistant Examiner*—McDieunel Marc
(74) *Attorney, Agent, or Firm*—Frommer Lawrence & Haug LLP; William S. Frommer

(57) ABSTRACT

A clicker-training technique developed for animal training is adapted for training robots, notably autonomous animal-like robots. In this robot-training method, a behaviour (for example, (DIG)) is broken down into smaller achievable responses ((SIT)-(HELLO)-(DIG)) that will eventually lead to the desired final behaviour. The robot is guided progressively to the correct behaviour through the use, normally the repeated use, of a secondary reinforcer. When the correct behaviour has been achieved, a primary reinforcer is applied so that the desired behaviour can be "captured". This method can be used for training a robot to perform, on command, rare behaviours or a sequence of behaviours (typically actions). This method can also be used to ensure that a robot is focusing its attention upon a desired object.

17 Claims, 1 Drawing Sheet

OTHER PUBLICATIONS

"The art of creating subjective reality: an analysis of Japanese digital pets" by M. Kusahara, in the Proceedings of the Artificial Life VII Workshop, 2000, ed. C. Maley and E. Boudreau, pp. 141–144.

"Experiments of human–robot communication with robota, an interactive learning and communicating doll robot." By A. Billard, K. Dautenhahn and G. Hayes, from "Socially situated intelligence workshop" (SAB 98) eds. B. Edmonds and K. Dautenhahn, 1998, pp. 4–16.

"Experimental results of emotionally grounded symbol acquisition by four–legged robot" by M. Fujita, G. Costa, T. Takagi, R. Hasegawa, J. Yokono and H. Shimura, in the Proceedings of Autonomous Agents 2001, 2001.

"Learning to behave: Interacting agents" by F. Kaplan, from the CELE–TWENTE Workshop on Language Technology, Oct., 2000, pp. 57–63.

"Learning from sights and sounds: a computational model" PhD thesis by D. Roy, MIT Media Laboratory, 1999.

"Behaviour–based robotics" by R. Arkin, MIT Press, Cambridge Mass., USA, 1998.

"Understanding intelligence" by R. Pfeiffer and C. Sheier, MIT Press, Cambridge, Mass., USA, 1999.

"The 'artificial life'route to 'artificial intelligence' . Building situated embodied agents." by L. Steels and R. Brooks, Lawrence Erlbaum Ass., New Haven, USA, 1994.

"What does robotics offer animal behaviour?" by Barbara Webb, Animal Behaviour, 60:545–558, 2000.

"An overview of robot imitation." by P. Bakker and Y. Kuiyoshi in the Proceedings of AISB Workshop on Learning in Robots and Animals, 1996.

The paper by A. Billard et al cited supra; "Getting to know each other: Artificial social intelligence for autonomous robots" by K. Sautenhahn in Robotics and autonomous systems, 16:333–356, 1995.

"Learning by watching: Extracting reusable task knowledge from visual observation of human performance" by T. Kuniyoshi, M. Inaba and H. Inoue in IEEE Transactions on Robotics and Automation, 10(6):799–822, 1994.

"The Behaviour of Organisms" by B.F. Skinner, Appleton Century Crofs, New York, N.Y., USA, 1938).

"Interactive training for synthetic characters" by S–Y. Yoon, R. Burke and G. Schneider, in AAAI 2000, 2000.

Nakata et al., Producing animal–like and frindly impressions on artifacts and analyzing their effect on human behavioral attitudes, 1999, IEEE, pp. ll–1035 –ll–1040.*

* cited by examiner

TRAINING OF AUTONOMOUS ROBOTS

BACKGROUND OF THE INVENTION

1. Field of the Invention

The present invention relates to the solution of human-robot interaction problems and, more especially, to the training of robots, notably autonomous robots such as the animal-like robots that have recently come into use.

2. Description of Related Art Including Information Disclosed under 37 CFR 1.97 and 1.98

In recent years there has been an increase in the number of autonomous animal-like robots that have been developed and put on the market, such as Sony Corporation's four-legged AIBO™ robot, which resembles a dog—see "Development of an autonomous quadruped robot for robot entertainment" by M. Fujita and H. Kitano, in Autonomous Robots, 5, 1998. See also "Robots for kids: Exploring new technologies for learning", by A. Drum and J. Hendler, Morgan Kaufman Publishers, 2000, and "The art of creating subjective reality: an analysis of Japanese digital pets" by M. Kusahara, in the Proceedings of the Artificial Life VII Workshop, 2000, ed. C. Maley and E. Boudreau, pages 141–144.

These autonomous robots are designed not as slaves programmed to follow commands without question, but as artificial creatures fulfilling their own drives. Part of the interest found in owning or interacting with such an autonomous robot is the impression the user receives that a relationship is being developed with a quasi-pet. However, autonomous robots can be likened to "wild" animals. The satisfaction that the user finds in interacting with the autonomous robot is enhanced if the user can "tame" the robot, to the extent that the user can induce the robot to perform certain desired behaviours on command and/or to direct its attention at, and learn the name of, a desired object.

To the user, it appears that he is "training" the robot, by analogy with human-animal interactions. However, given that the robot is more accurately be described as a kind of dynamic programming in the field. In the present document, references to "training" should be understood in this sense.

However, it is difficult to train an autonomous robot to perform specific tasks on command, especially tasks involving an unusual pattern of behaviour or a sequence of actions, or to learn the name for specific objects. Several groups are involved in research in this field, see, for example, "Experiments on human-robot communication with robota, an interactive learning and communicating doll robot." by A. Billard, K. Dautenhahn and G. Hayes, from "Socially situated intelligence workshop" (SAB 98), eds. B. Edmonds and K. Dautenhahn, 1998, pages 4–16; "Experimental results of emotionally grounded symbol acquisition by four-legged robot" by M. Fujita, G. Costa, T. Takagi, R. Hasegawa, J. Yokono and H. Shimura, in the Proceedings of Autonomous Agents 2001, 2001; "Learning to behave: Interacting agents" by F. Kaplan, from the CELE-TWENTE Workshop on Language Technology, October 2000, pages 57–63; and "Learning from sights and sounds: a computational model" PhD thesis by D. Roy, MIT Media Laboratory, 1999.

The present inventors, considering that the problems involved in teaching a complex behaviour (and associated command) to an autonomous robot, and/or in reaching shared attention with an autonomous robot such that the name of a desired object could be taught, are similar to the problems faced by animal trainers, determined that robots could be trained by application of techniques used for pet training.

Over the last fifty years, there have been some fruitful exchanges between ethologists and robotics engineers. For example, in some cases robotics engineers have defined control architectures for robots, based on observations about animal behaviour. Different surveys of behaviour-based robotics are given in "Behaviour-based robotics" by R. Arkin, MIT Press, Cambridge Mass., USA, 1998; in "Understanding intelligence" by R. Pfeiffer and C. Sheier, MIT Press, Cambridge, Mass., USA, 1999; and in "The 'artificial life' route to 'artificial intelligence'. Building situated embodied agents," by L. Steels and R. Brooks, Lawrence Erlbaum Ass., New Haven, USA, 1994. Robot-based research has also led to development of models that may be useful for understanding animal behaviour—see "What does robotics offer animal behaviour?" by Barbara Webb, Animal Behaviour, 60:545–558, 2000. However, so far, when tackling robotics problems robotics researchers have not made many investigations in the field of animal training.

The method most often used by dog owners attempting to train their pets, for example, to sit down on command, involves chanting the command (here "SIT") several times, whilst simultaneously forcing the animal to demonstrate the desired behaviour (here by pushing the dog's rear down to the ground). This method fails to give good results for various reasons. Firstly, the animal is forced to choose between paying attention to the trainer's repeated word, or to the behaviour to be learnt. Secondly, as the command is repeated several times, the animal does not know which part of its behaviour to associate with the command. Finally, very often the command is said before the behaviour is exhibited; for instanced "SIT" is said while the animal is still in a standing position. Thus, the animal cannot associate the command with the desired sitting position.

For these reasons, animal trainers usually one of the techniques listed below (which involve teaching a desired behaviour) first, and then add the associated command. The main techniques are:

the modelling method, the luring method, the capturing method, the imitation method, and shaping methods.

The present inventors considered that it was advisable to follow the same sort of approach when training a robot, given that the problem of sharing attention and discrimination stimuli is even more difficult with a robot than with an animal.

The modelling method is another technique often tried by dog owners but rarely adopted by professional trainers. This involves physically manipulating the animal into the desired position and then giving positive feedback when the position is achieved. Learning performance is poor, because the animal remains passive throughout the process. Modelling has been used in an industrial context to teach positions to non-autonomous robots. However, for autonomous robots which are constantly active, modelling is problematic. Only partial modelling could be envisaged. For instance, the robot would be able to sense that the trainer is pushing on its back and then decide to sit, if programmed to do so. However, it is hard to generalise this method to the training of complex movements involving more than just reaching a static position.

The luring method is similar to modelling except that it does not involve a physical contact with the animal. A toy or treat is put in front of the dog's nose and the trainer can use this to guide the animal into the desired position. This method gives satisfactory results with real dogs but can only be used for teaching position or very simple movement. Luring has not been used much in robotics. The AIBO™ robots that have been released commercially are programmed to be interested automatically in red objects. Some owners of these robots use this tendency so as to guide their artificial pet into desired places. However, this usage remains fairly limited.

In contrast to the modelling and luring methods, the capturing methods exploit behaviours that the animal produces spontaneously. For instance, every time a dog owner acknowledges his pet is in the desired position or performing the right behaviour this gives a positive reinforcement.

The present inventors investigated the suitability of a capturing technique for training autonomous robots, using a simple prototype. The robot was programmed to perform autonomously successive random behaviours, some of which corresponded to desired behaviours with which it was wished to associate a respective signal (for example, a word). Each time the robot spontaneously performed one of the desired behaviours the corresponding signal was presented to the robot immediately afterwards. For example, to teach the robot the word "SIT", the trainer had to wait until the robot spontaneously sat down, then he would say the word "SIT". However, this technique did not work well in the case where the number of behaviours that could receive a name was too large. The time taken to wait for the robot spontaneously to exhibit the corresponding behaviour was too long.

Imitation methods involve the trainer in exhibiting the desired behaviour so as to encourage the animal (or robot) to imitate the trainer. This technique is seldom used by professional animal trainers in view of the differences between human and animal anatomy. Success has been acknowledged only with "higher animals" such as primates, cetaceans and humans. However, this approach has been used in the field of robotics—see, for example, "An overview of robot imitation." by P. Bakker and Y. Kuniyoshi in the Proceedings of AISB Workshop on Learning in Robots and Animals, 1996; the paper by A. Billard et al cited supra; "Getting to know each other: artificial social intelligence for autonomous robots" by K. Dautenhahn in Robotics and autonomous systems, 16:333–356, 1995; and "Learning by watching: Extracting reusable task knowledge from visual observation of human performance" by T. Kuniyoshi, M. Inaba and H. Inoue in IEEE Transactions on Robotics and Automation, 10(6):799–822, 1994.

In principle, methods based on imitation can handle very rare behaviours, and sequences of actions. However, in practice very heavy computational power is required in the robot. It is therefore difficult to envisage use of such methods for currently available autonomous robots.

The shaping method involves breaking a behaviour down into small achievable responses that will eventually be joined into a sequence to produce the overall desired behaviour. The main idea is to guide the animal progressively towards the right behaviour. Each component step can be trained using any of the other known training techniques. Various shaping methods are known including one designated a "clicker training" method.

Clicker training is based on B. F. Skinner's theory of Operant conditioning (see "The Behaviour of Organisms" by B. F. Skinner, Appleton Century Crofs, New York, N.Y., USA, 1938). This method has proven to be one of the most efficient for training a large variety of animals, including dogs, dolphins and chickens. During the 1980s, Gary Wilkes, a behaviourist, collaborated with Karen Pryor, a dolphin trainer, to popularise this method for dog training. Whereas, for dolphin training, the dolphins were given stimuli in the form of whistles, for dog training the whistles were replaced by a small metal device (the "clicker") that emitted a brief and sharp clicking sound.

In clicker training, the animal comes to associate the clicker sound (which, in itself, does not mean anything to the animal) with a primary reinforcer that the animal instinctively finds rewarding—typically a treat such as food, toys, etc. After having been associated a number of times with the primary reinforcer, the clicker becomes a secondary reinforcer (also called a conditioned reinforcer), and acts as a clue signalling that a reward will come soon. Because the clicker is not the reward in itself, it can be used to guide the animal in the right direction. It is also a more precise way to signal which particular behaviour needs to be reinforced. The trainer only gives the primary reinforcer when the animal performs the desired behaviour. This signals the end of the guiding process.

Thus, the clicker training process involves at least four stages:

"charging up" the clicker: During this first process the animal has to learn to associate the click with the reward (the treat). This is achieved by clicking and then giving the animal the treat, consistently for around 20–50 times, until it gets visibly excited by the sound of the clicker.

Getting the behaviour: then the animal is guided to perform the desired action. For instance, if the trainer wants the dog to spin in a circle in a clockwise direction he or she will start by clicking each time the dog makes the slightest head movement to the right. when the dog performs the head movement consistently, the trainer clicks only when it starts to turn its body to the right. The criteria for obtaining a click are raised slowly until a full spin of the body is achieved. At this stage the treat is given.

Adding the command word: The command word is said only when the animal has learned the desired behaviour. The trainer needs to say the command just after or just before the animal performs the behaviour.

Testing the behaviour: Then the learned behaviour needs to be tested and refined. The trainer uses the command word, clicks and rewards with a treat only when the exact desired behaviour is performed.

It is important to note that, as clicker training is used for guiding the animal towards performing a behaviour via a sequence of steps, it can be used not only for the animal to learn an unusual behaviour that the animal hardly ever performs spontaneously, but also for the animal to learn to perform a sequence of behaviours.

Table 1 summarises the suitability of the various abovementioned techniques for training animals and considers whether they might be applied to training robots.

TABLE 1

| Training technique | Can train sequences of actions ? | Can train unusual actions ? | Usability with animals | Usability for autonomous robots |
|---|---|---|---|---|
| Modelling | no | difficult | seldom used | difficult |
| Luring | difficult | difficult | good for simple actions | seldom used |
| Capturing | no | no | good | good |
| Imitating | yes | yes | seldom used | difficult |
| Shaping | yes | yes | very good | not used yet |

BRIEF SUMMARY OF THE INVENTION

According to the preferred embodiments of the present invention, the clicker training technique is applied for training robots, notably autonomous robots, to perform desired behaviours and/or to direct attention to a desired object (so that the name can be learned). Although attempts have been made to user clicker training to train a virtual character displayed on a screen (see "Interactive training for synthetic characters" by S-Y. Yoon, R. Burke and G. Schneider, in AAAI 2000, 2000), it is believed that this is the first time that a robot-training technique has been based on this kind of method.

More particularly, the present invention provides a robot-training method in which a behaviour is broken down into smaller achievable responses that will eventually lead to the desired final behaviour. The robot is guided progressively to the correct behaviour through the use, normally the repeated use, of a secondary reinforcer. When the correct behaviour has been achieved, a primary reinforcer is applied so that the desired behaviour can be "captured".

The robot-training method of the present invention enables complex and/or rare behaviours, and sequences of behaviours, to be taught to robots. It is especially well adapted to the training of autonomous animal-like robots. It has the advantage that it is simple to implement and requires relatively low computational power.

The desired behaviour can correspond to the overall sequence of smaller achievable responses, or merely to the last of the sequence.

The desired behaviour can be the directing of the robot's attention to a particular subject. Thus, the present invention provides a simple way to overcome the problem of ensuring "shared attention" between a robot and another (typically a person attempting to teach the robot the names of objects).

The robot is adapted (typically by pre-programming) to respond to the secondary reinforcer(s) by exploring behaviours "close to" the behaviour that prompted the issuing of the secondary reinforcer. The robot is further adapted to respond to the primary reinforcer by registering the behaviour (or sequence of behaviours) that prompted the issuing of the primary reinforcer and, preferably, by registering a command indication that the trainer issued after the primary reinforcer.

In general, the primary reinforcer(s) will be programmed into the robot whereas the secondary reinforcers are learned (either via a predetermined registration procedure or via a conditioning process teaching the robot by associating the secondary reinforcer with a primary reinforcer).

These and further features and advantages of the present invention will become clear from the following description of a preferred embodiment thereof, given by way of example, and illustrated with reference to the accompanying drawings, in which:

BRIEF DESCRIPTION OF THE SEVERAL VIEWS OF THE DRAWINGS

FIG. 2 shows pictures of the AIBO™ robot performing various of the behaviours of FIG. 1, in which:

DETAILED DESCRIPTION OF THE INVENTION

Figure 1:
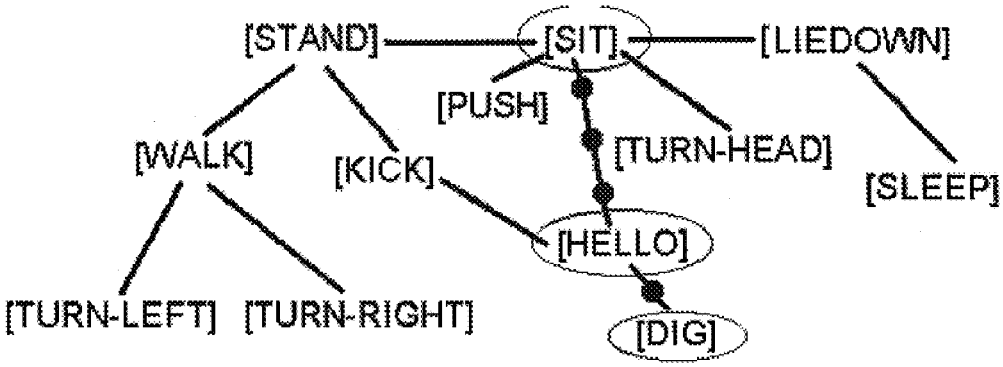
FIG. 1 illustrates part of the behaviour graph of an enhanced AIBO™ robot.

The following detailed description of a robot-training method according to the preferred embodiment of the present invention is given with reference to training of an enhanced version of the AIBO™ robot manufactured by Sony Corporation. However, it is to be understood that the present invention is more widely applicable to training of robots in general, notably autonomous robots.

The AIBO™ robot is a four-legged robot that resembles a dog. It has a very large set of pre-programmed behaviours. In its usual autonomous mode, the robot switches between these behaviours according to the evolution of its internal drives or "motivations" and of the opportunities afforded by the environment, in a manner programmed beforehand, (for details, see the paper by Fujita et al cited supra). It can be considered that there is a topology of the robot's behaviours defining which behaviours and transitions between behaviours are permissible. Such a topology exists, for example, because certain transitions are impossible due to the robot's anatomy. Also, in the absence of such a topology, the robot could change from one behaviour to another completely unrelated behaviour at random and its behaviour would appear to be chaotic. Some behaviours are performed fairly often, for example, chasing and kicking a ball, whereas other behaviours are normally almost never observed, for example, the robot can perform some special dances and do some gymnastic moves. Below a description will be given as to how the robot can be trained to perform such unusual behaviours on command, by using the robot-training method according to the preferred embodiment of the invention, based on clicker training.

As explained above, clicker training for animals has four phases. The method of the present invention has phases similar to these, adapted to be suited for training robots.

The first phase of the method is analogous to the animal clicker-training phase designated "charging up the clicker". It involves finding suitable primary and secondary reinforcers and conditioning the robot to know that the secondary reinforcer is associated with the primary reinforcer. Clearly both the primary and secondary reinforcers must be stimuli detectable by the robot (thus, it would be useless to use a visual stimulus for a robot which lacked the capability to detect and differentiate between different visual stimuli, or a sound stimulus for a robot incapable of detecting sounds, etc.). For a robot, it can be argued that any event fulfilling one or more of the robot drives (for example, providing the robot with a recharged battery) is a "natural" primary reinforcer. However, in practice it is difficult to use such "natural" primary reinforcers. It is preferred to select a primary reinforcer and program the robot with knowledge thereof. In the present case, two alternative primary reinforcers were used, a pat on the head (detected as a change in pressure via a pressure sensor on the robot head) and the utterance of the word "Bravo" (an easily distinguished vocal congratulation). However, any other suitable reinforcer perceptible to the robot could have been used.

The secondary reinforcer need not have any inherent "worth" for the robot, since it acquires worth via its association with the primary reinforcer. However, the user obtains greater satisfaction if he or she can select a specific and personal secondary reinforcer. Once again, this reinforcer can be anything ranging from a particular visual stimulus (for example, detection of a special object in the image viewed by the robot) to a vocal utterance. However, it is important that the secondary reinforcer be quick enough to "emit" and easy to detect so that it can act as a good indicator to guide the robot towards the correct behaviour. Here, the chosen secondary reinforcer was utterance of the word "good".

The robot is conditioned to associate the secondary reinforcer (here the spoken word "good") with the primary reinforcer (here a pat on the head or the spoken congratulation "Bravo!"). One way of achieving this conditioning is by successively subjecting the robot to the succession of stimuli <secondary reinforcer><primary reinforcer>, preferably more than 30 times. Because the primary reinforcer is perceived following the secondary reinforcer a statistically significant number of times, the robot is programmed to register that the signal preceding the primary reinforcer is a secondary reinforcer. An alternative (and simpler) method consists in programming the robot to have a registration procedure for the secondary reinforcer. For example, pressing twice on the robot's front left foot might signal to the robot that the next stimulus is to be registered as a secondary reinforcer. The robot is adapted (typically by programming) such that when it has become conditioned to or otherwise registered a secondary reinforcer it provides and acknowledgement, for example, an eye-flash, a tail movement or a happy sound. These methods can be used to condition the robot to learn several different secondary reinforcers.

As mentioned above, the robot is adapted (typically by pre-programming) to respond to the secondary reinforcer(s) by exploring behaviours "close to" the behaviour that prompted the issuing of the secondary reinforcer. The robot is further adapted to respond to the primary reinforcer by registering the behaviour (or sequence of behaviours) that prompted the issuing of the primary reinforcer and, preferably, by registering a command indication that the trainer issued after the primary reinforcer.

Once the robot has been conditioned to learn one or more secondary reinforcers, in a second phase of the training the trainer can use these secondary reinforcers to guide the robot towards learning a desired behaviour. During this training phase, the trainer uses the secondary reinforcer to signal to the robot that its behaviour is approaching more and more closely to the desired behaviour. Deciding whether the behaviour is approaching more and more closely to the desired behaviour can be judged with reference to the topology of the robot's behaviours.

There are different methods for determining the topology of the robot's behaviours. However, before discussing some of these methods, it should be mentioned that, for a robot whose behaviours are the result of actions performed by combinations of independent actuators, it is a straightforward matter to determine when the secondary reinforcer should be used. The secondary reinforcer can be used for any behaviour which involves correct activation of one of the combination of actuators corresponding to the desired overall behaviour.

In the case of the AIBO™ robot, the behaviours are pre-programmed high-level actions, such as (kick), (stand), etc. For this case, two different methods for defining a topology of the robot's behaviours were considered.

The first method involved building a description of the behaviour space; each behaviour can be described by a set of characteristics. These characteristics can be classified as descriptive characteristics and intentional characteristics. Descriptive characteristics relate to physical parameters such as, for instance, the starting position of the robot (standing, sitting, lying), which body part is involved (head, leg, tail, eye), whether or not the robot emits a sound, etc. Intentional characteristics describe the goals that are driving the behaviours, for instance whether it is a behaviour for moving, for grasping or for getting attention. Each behaviour can be viewed as a point in the space defined using these characteristics as the dimensions of the space. When all of the behaviours have been formalised by plotting with respect to these dimensions, then it is possible to define a "distance" between two behaviours and to see the route needed to navigate from one behaviour to a "similar" one. The main advantage of this method lies in that, once the characteristics are chosen, the description of a complete set of behaviours can be done quickly. However, there is a drawback in that the transitions between behaviours are not always predictable.

The second method for defining the topology of the robot's behaviours is simply to build a probabilistic graph specifying the possible transitions between the various behaviours. After having performed one behaviour, different transitions are possible depending upon the probability of the respective arcs. This method takes longer to perform but it enables better control over the kind of transitions that the robot can perform. As in the first method, this second method enables objective resemblances between behaviours to be combined with some criterion(a) dealing with "intention". It also enables the distinction between common behaviours (e.g. (sit), (stand), etc.) and rare behaviours (performing a special dance, doing gymnastic exercises, etc.) to be more closely controlled. For the above-mentioned reasons, according to the preferred embodiment of the present invention, it is preferred to define the topology of the robot's behaviour using this second method.

As an illustration, FIG. 1 shows part of the topology of the robot's behaviour, defined using the probabilistic graph formalism according to this second method. In FIG. 1, different behaviours are indicated enclosed in square brackets and the lines connecting bracketed terms indicate the possible transitions between behaviours. The ringed behaviours linked by a dot chain line indicate an example of a guided route to the behaviour (dig). This will be discussed in more detail below with reference to FIG. 2.

We shall now consider the case where the trainer wishes to teach the robot to perform, on command, the rare digging behaviour, which corresponds to the node labelled (DIG) in FIG. 1. In this behaviour, the robot is sitting and uses its left front paw to scratch the ground. The robot's head looks down at its paw and follows the movement. The training process may follow the pattern illustrated in FIG. 2.

Figure 2A:
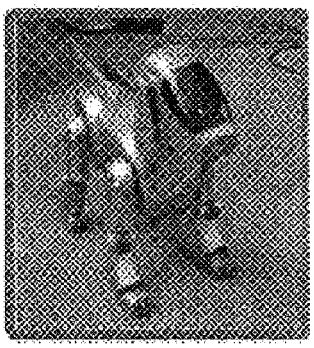
FIG. 2A corresponds to a behaviour (STAND)
Figure 2B:
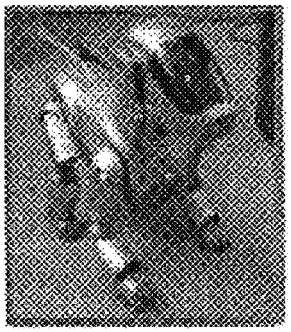
FIG. 2B corresponds to a behaviour (WALK)
Figure 2C:
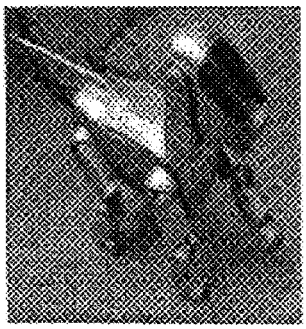
FIG. 2C corresponds to a behaviour (KICK)
Figure 2D:
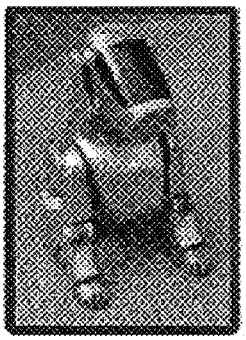
FIG. 2D corresponds to a behaviour (SIT)

Let us assume that, initially, the robot is standing (STAND) node in FIG. 1), as shown in FIG. 2A. First of all the robot starts walking ((WALK) IN FIG. 1), as shown in FIG. 2B. This transition leads no nearer to the desired behaviour (DIG) so the trainer does not give any reinforcing stimuli. In the absence of any reinforcer from the trainer, the robot tries another behaviour, in this case it raises its left front leg to kick, as illustrated in FIG. 2C ((KICK) node in FIG. 1). Once again, the trainer considers that this behaviour does not lead closer to the desired behaviour (DIG) and emits no reinforcer. As no reinforcer is perceived, the robot tries another behaviour, this time it sits down (see FIG. 2D). Since a sitting position is required for the (DIG) behaviour, the trainer considers that this behaviour is closer to the desired behaviour and for the first time emits the secondary reinforcer (here the spoken word "good").

Figure 2E:
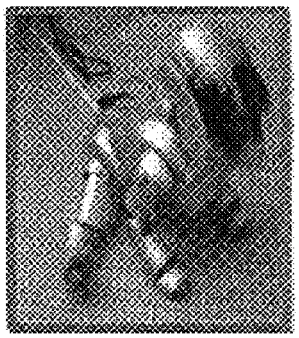
FIG. 2E corresponds to a behaviour (PUSH)
Figure 2F:
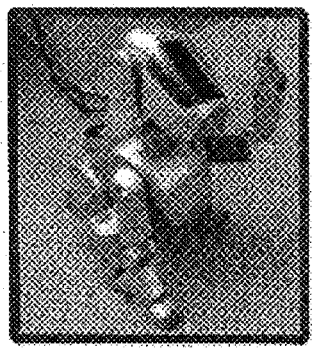
FIG. 2F corresponds to a behaviour (HELLO)
Figure 2G:
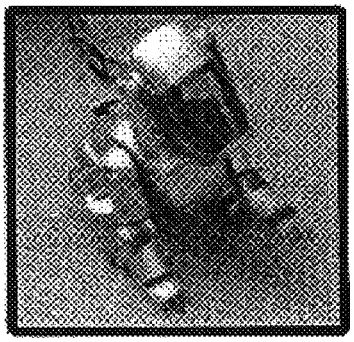
FIG. 2G corresponds to a behaviour (DIG).

The robot next tries some behaviours associated with the (SIT) node. First, as illustrated in FIG. 2E, it starts pushing with its two front legs (which corresponds to the behaviour (PUSH) of FIG. 1). The trainer does not utter any reinforcer. In the absence of any reinforcer, the robot tries another behaviour, lifting its left front leg as if to wave "hello", as shown in FIG. 2F. This behaviour involves use of the front left paw and, thus, is closer to the desired (DIG) behaviour so the trainer again emits the secondary reinforcer (he or she says "good"). After trying several other behaviours that involve the front left leg the robot tries digging, as shown in FIG. 2G. As this is the desired behaviour the trainer rewards the robot with the primary reinforcer (here, for example, the spoken word "Bravo!").

The guided route illustrated by the dot chain line in FIG. 1 is not the only one that could have been used for this phase of the robot's training. The trainer could have guided the robot towards movements of the front left leg by emitting a secondary reinforcer when the robot performed the (KICK) behaviour (FIG. 2C). Then the trainer could have waited for the robot to sit down and then emitted a secondary reinforcer once again. Finally, the primary reinforcer would be issued when the robot exhibited the (DIG) behaviour.

When the robot has performed the desired behaviour and learned to identify it as such (by perception of the primary reinforcer), the trainer can immediately add the desired command indication, typically a spoken command word, that will be used in the future to elicit the desired behaviour from the robot. However, it is preferable to obtain some kind of feedback from the robot to ensure that the correct command indication has been understood. The robot can be programmed so that, when it has perceived a primary reinforcer it next expects to register a command indication and, once it has perceived something it considers to be the command indication, it will give such feedback. For example, in the case where the command indication is a spoken command word, and if the robot is capable of speaking, the robot can be programmed to repeat the command word and ask for confirmation. In this example, if the robot cannot speak, it could give some other indication (e.g. blinking of its eyes) that it considers that a new command word has been spoken, and await a second utterance of the command word. If it perceives repetition of the command word, the robot will learn the command word, if it does not perceive the same command word, it will signal its lack of comprehension in some way (e.g. hanging its head). This encourages the trainer to try again.

The command word is associated not simply with the last behaviour but with all the behaviours that have marked as "good" (by secondary reinforcers) along the route leading towards the primary reinforcer/new command word. At this stage the robot does not know whether the command word should be associated with the sequence of "good" behaviours or just with the final behaviour. Thus, there is a further phase in the preferred embodiment of robot training method, namely a phase of testing the behaviour.

After having understood the command indication the robot will spontaneously repeat the sequence of reinforced actions that have led to the primary reinforcer. In the above-described example, this sequence of actions (or behaviours) is (SIT-HELLO-DIG). If, after it performs the sequence, the robot perceives a primary reinforcer it will consider that the command refers to the whole sequence. If not, it will produce a new sequence derived from the former one but involving fewer steps. It will continue like this so long as it does not perceive a primary reinforcer. Eventually it might end by considering that the command applies only to the final behaviour in the sequence.

Experiments

Experiments were performed using the AIBO™ robot to test how well the clicker-training based techniques of the present invention succeeded in training an autonomous robot to perform an unusual behaviour. In these experiments, a computer external to the robot was used to perform all of the additional computations concerning the training interactions. The computer implemented speech recognition so as to enable interactions using real words. The computer also implemented a protocol for sending/receiving data between the computer and the robot via a radio connection. However, it is to be understood that, for a robot of suitable processing power, and an appropriate choice of primary and secondary reinforcers, the external computer can be dispensed with.

In the experiments that were conducted, a number of individuals were asked to train an AIBO™ robot using the method according to the above-described preferred embodiment of the invention. Although this training technique did not come naturally to those individuals who were inexperienced in dog training, they appeared to understand and apply the method without difficulty. Once the method was understood, the training process was generally perceived by the human participants as if it were a game. Indeed, after training the robot to perform the (DIG) behaviour on command, the users vied with each other to attempt to train the robots to perform increasingly rare and amusing behaviours. Many discovered that they could use an initially taught command (such as (DIG)) as the starting point for more rapidly training a new and even more unusual behaviour.

The congeniality (or otherwise) of the robot-training method according to the present invention, for the human trainer, depends upon the definition of the topology of the robot's behaviours. A definition which the user does not know a priori but can only infer by observation of the robot. In particular, the proposed route through the topology, for guiding the robot towards a desired behaviour, needs to match well with the particular way the trainer perceives whether an action is going in the right direction or not. Although some transitions feel "natural" for everybody others (especially those defined with "intentional" criteria) can be perceived very differently depending upon the individual trainer involved. Therefore, the success of otherwise of the training method according to the invention depends upon the topology of the robot's behaviours (and the transitions therein).

One way of coping with this problem is to design the topology of behaviours (by appropriate programming of the robot) such that the transitions between behaviours will appear to be natural ones, perhaps mimicking behaviour seen in animals. Another way is to combine the clicker-training based method of the present invention with luring methods. This avoids the need to wait for a desired behaviour to be performed spontaneously. Professional animal trainers combine these two types of techniques for the same reason.

However, a further and better way of coping with the problem is to program the robot such that, during training, the probability of a particular transition taking place will be modified in a dynamic manner. Initially the probabilistic behaviour graph is very large with roughly equal probabilities of transitions between any pair of nodes. However, the robot can be programmed such that, when it perceives that a particular transition is followed by perception of a secondary reinforcer, the probability of that transition occurring in the future is increased. With this modified method, the robot tends to exhibit more frequently those behaviour transitions that the user likes or finds natural.

As described above, in the preferred embodiment of the invention, a fixed graph of the robot's behaviours is used. This has the advantage of being a simpler method and the transitions in the robot's behaviour are more predictable. However, the design of a "natural" graph is a difficult task. The modified version of the preferred embodiment, in which the probabilities of transitions are updated dependent upon perception of a secondary reinforcer, is more complex to implement but much more interesting. For example, when the user says "good" as the robot has just tried the (HELLO) behaviour when it was sitting, there are two effects: (1) the robot's behaviour moves from (SIT) to (HELLO) and the robot starts to explore behaviour the behaviours available in transition from the (HELLO) node, and (2) the probability of the transition from (SIT) to (HELLO) is increased. In this way, the robot's behaviour can be influenced in a manner which is even more dependent upon its interactions with the human user.

The above description of the preferred embodiment of the invention was given primarily in terms of the teaching of a robot to perform a desired action. However, the invention is more widely applicable to the training of behaviour in general. For example, in the field of robotics a particular problem is ensuring that the robot and a human user are focusing their attention on the same subject (using a physical object). This problem of "shared attention" is crucial when it comes to teaching the robot the names of objects. The present invention can be applied to ensure that the robot directs its attention at a desired object. In particular, the secondary reinforcer can be emitted as the robot directs its attention more and more closely to the desired object. When the robot is directing its attention at the desired object a primary reinforcer is given (and the name of the object can be said, in a suitable case).

It is to be understood that the present invention is not limited by the detailed features of the specific embodiments described above. More particularly, numerous modifications and adaptations may be made without departing from the invention as defined in the claims.

What is claimed is:

1. A method of programming a robot to perform a desired behaviour, the method comprising the steps of:

providing a robot for recognizing at least one stimulus as a primary reinforcer and;

conditioning the robot to recognize at least one further stimulus as a secondary reinforcer;

guiding the robot to the desired behaviour by presenting the robot with a secondary reinforcer when the robot exhibits a behaviour approaching the desired behaviour and presenting the robot with a primary reinforcer when the robot exhibits the desired behaviour.

2. The robot programming method of claim 1, wherein the providing step comprises providing a robot which, in use, in response to perception of a secondary reinforcer, exhibits a behaviour related to the exhibited behaviour that prompted appearance of the secondary reinforcer and, in response to perception of a primary reinforcer, registers one or more of the exhibited behaviours that prompted appearance of the primary reinforcer.

3. The robot programming method of claim 2, wherein the providing step comprises providing a robot which, in use, in response to perception of a primary reinforcer, repeats the one or more registered behaviours, and the method further comprises the step of presenting the robot with a primary reinforcer if the repeated one or more behaviours corresponds to the desired behaviour.

4. A method according to claim 1, for programming a robot to perform a sequence of desired behaviours, the method comprising the step of presenting the robot with a secondary reinforcer when the robot exhibits a desired behaviour of said sequence and presenting the robot with a primary reinforcer after the robot has exhibited the sequence of desired behaviours.

5. The robot programming method of claim 1, wherein the desired behaviour is the directing of the robot's attention on a particular subject, and the guiding step comprises presenting the robot with a secondary reinforcer as the robot directs the visual apparatus thereof more and more precisely towards said particular subject and presenting the robot with a primary reinforcer when the robot directs the visual apparatus thereof at said particular subject.

6. The robot programming method of claim 1, wherein the step of conditioning the robot to recognize at least one further stimulus as a secondary reinforcer comprises repeatedly presenting the robot with said further stimulus in association with a primary reinforcer.

7. The robot programming method of claim 1, and comprising the step of providing the robot with a command indication immediately after provision of a primary reinforcer.

8. The robot programming method of claim 7, wherein the providing step comprises providing a robot which, in use, provides feedback enabling the command indication to be confirmed.

9. The robot programming method of claim 7, wherein the command indication is a spoken word or hand signal.

10. The robot programming method of claim 1, wherein the providing step comprises providing a robot which, in use, undergoes a transition from one behaviour to another behaviour thereof according to a respective probability, wherein the probability of a transition taking place between a particular pair of behaviours is increased if the exhibition of said transition occurs and prompts appearance of a secondary or primary reinforcer.

11. An autonomous robot programmable by a method according to claim 1, wherein the robot comprises:

means for recognizing at least one stimulus as a primary reinforcer, and means for enabling at least one further stimulus to be identified as a secondary reinforcer.

12. The autonomous robot according to claim 11, which, in use, in response to perception of a secondary reinforcer, exhibits a behaviour related to to the exhibited behaviour that prompted appearance of the secondary reinforcer and, in response to perception of a primary reinforcer, registers one or more of the exhibited behaviours that prompted appearance of the primary reinforcer.

13. The autonomous robot according to claim 12, which, in use, in response to perception of a primary reinforcer, repeats the one or more registered behaviours, and confirms registration of said one or more behaviours if the repetition prompts appearance of a primary reinforcer.

14. The autonomous robot according to claim 11, wherein said enabling means for recognizing at least one further stimulus as a secondary reinforcer when the robot perceives said further stimulus repeatedly presented thereto in association with a primary stimulus.

15. The autonomous robot according to claim 11, which, in use, in response to perception of a primary reinforcer, awaits presentation of, and registers, a command indication.

16. The autonomous robot according to claim 15, which, in use, provides feedback enabling the command indication to be confirmed.

17. The autonomous robot according to claim 11, which, in use, undergoes a transition from one behaviour to another behaviour thereof according to a respective probability, wherein the probability of a transition taking place between a particular pair of behaviours is increased if the exhibition of said transition occurs and prompts appearance of a secondary or primary reinforcer.

* * * * *